United States Patent [19]

Thal, Jr.

[11] Patent Number: 4,477,787

[45] Date of Patent: Oct. 16, 1984

[54] DUAL MODE DIRECTIONALLY COUPLED BAND REJECT FILTER APPARATUS

[75] Inventor: Herbert L. Thal, Jr., Tredyffrin Twp., Chester Co., Pa.

[73] Assignee: The United States of America as represented by the Secretary of the Air Force, Washington, D.C.

[21] Appl. No.: 459,159

[22] Filed: Jan. 19, 1983

[51] Int. Cl.[3] ..... H01P 1/208

[52] U.S. Cl. ..... 333/208; 333/209; 333/212; 333/232

[58] Field of Search ..... 333/202–212, 333/219, 227–233, 235, 245, 248, 108, 110, 126, 129, 134–135

[56] References Cited

U.S. PATENT DOCUMENTS 3,845,415 10/1974 Ando ..... 333/208 X
4,129,840 12/1978 Mok ..... 333/227 X
4,168,478 9/1979 Schuegraf ..... 333/208 X

OTHER PUBLICATIONS

Cohn et al.—"Directional Channel-Separation Filter," Proceedings of the IRE, Aug. 1956, pp. 1018–1024.

"Computer-Aided Filter Alignment and Diagnosis", Herbert L. Thal, Jr., Member, IEEE., IEEE Trans. on Microwave Theory and Techniques, vol. MTT-26, No. 12, Dec. 1978, pp. 958–963.

*Primary Examiner*—Marvin L. Nussbaum
*Attorney, Agent, or Firm*—Donald J. Singer; William Stepanishen

[57] ABSTRACT

A dual mode directionally coupled band reject filter apparatus having coaxially aligned first and second cylindrical cavity members which are asymmetrically mounted to the broadwall of a waveguide. Both cylindrical cavity members include a plurality of tuning screws to establish elliptic-type responses.

9 Claims, 5 Drawing Figures

FIG. 3
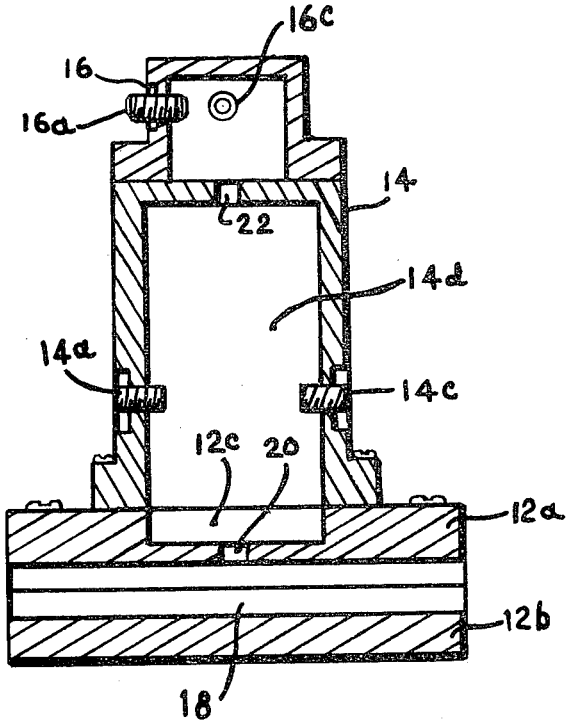
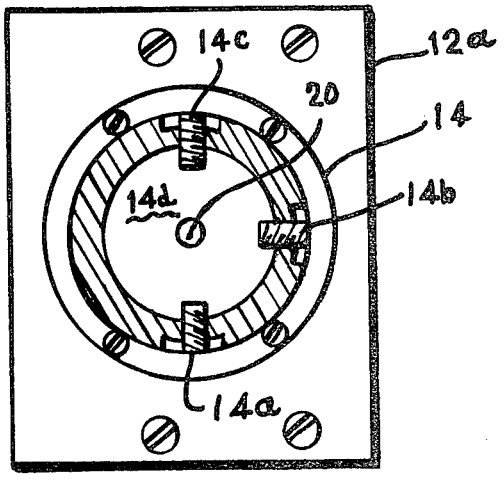
FIG. 4
FIG. 5
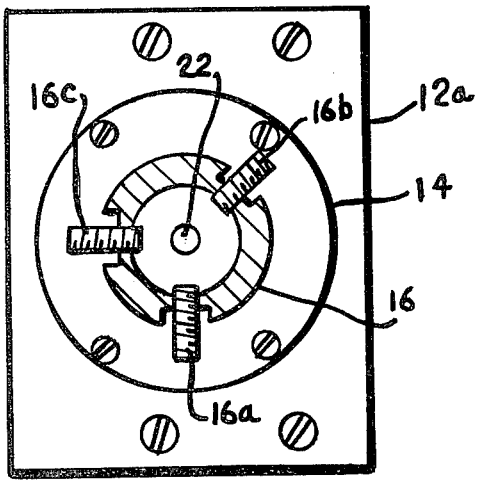

DUAL MODE DIRECTIONALLY COUPLED BAND REJECT FILTER APPARATUS

STATEMENT OF GOVERNMENT INTEREST

The invention described herein may be manufactured and used by or for the Government for governmental purposes without the payment of any royalty thereon.

BACKGROUND OF THE INVENTION

The present apparatus relates broadly to a microwave filter apparatus, and in particular to a dual mode directionally coupled band reject filter apparatus.

Microwave band rejection filters have been generally defined as combinations of resonant and antiresonant circuits connected to either transmission lines or waveguides so that the undesired band of frequencies is selectively attenuated from the total frequency spectrum. In the case of waveguide filters, the resonant circuits take the physical form of resonant cavities which are coupled to the waveguide by means of an opening or iris in the wall of the waveguide. The specific cross-sectional shape of the opening (round, square, rectangular, etc.) permits certain propagation modes of R-F energy to pass from the waveguide into the cavity thereby providing the excitation energy sufficient to propagate various modes within the cavity. The openings or irises which are associated with a given cavity are situated in odd multiples of $\lambda_g/4$, where $\lambda_g$ refers to the main waveguide wavelength. A quarter wavelength opening spacing provides an energy loss or attenuation over a particular spectral range due to the properly phased wave-cancellation which is caused by the resonant behavior of the cavities.

The amount of attenuation of waveguide energy at any given frequency is determined by the shape and positioning of the coupling opening, the dimensions and form of the cavity and the number of cavities employed in a given band rejection filter configuration. Attenuation characteristics may be predicted by utilizing lumped element prototype filter models which are well known in the art of conventional network synthesis techniques.

In the prior art, band reject waveguide filters which provide microwave band reject filtering have used rectangular or cylindrical cavities that are spatially situated along a straight section of waveguide such that each cavity will support a single mode of propagation. The openings which are associated with each such cavity have been located at a distance which is some multiple of a quarter wavelength of the waveguide signal along the length of a straight waveguide section. However, such configurations in the prior art have had the disadvantage of requiring large physical size, being physical complexity and incurring high fabrication costs.

Multicavity dual-mode band pass waveguide filters which utilize two or more cavities are well known in the prior art. Such waveguide filters provide two or more cavities each of which cavity resonates in two orthogonal modes and are coupled together through an iris or opening in a correct sequence. The various methods of coupling the respective cavities to the waveguide will provide desired response characteristics. The coupling between the modes in each of the cavities is provided by a structural discontinuity or obstacle which is placed in the cavity. The resonant frequency of each mode within each cavity may be adjusted by a respective tuning screw. In this way for a two cavity system, there are required two tuning screws in each of the cavities.

In such prior systems, the input is applied to the circular cross sectional end of one cavity and the output is taken from the opposing circular cross sectional end of the last cavity. Coupling between the cavities is provided by an iris positioned in a circular cross sectional separating each pair of cavities. However, these filters are band pass, not band reject and the modes in each cavity may be tuned by tuning screws positioned therein. One type of prior art arrangement utilizes a multicavity waveguide filter in which each of the cavities has a pair of orthogonally related modes of propagation. The cavities are positioned side by side with the long axis of each of the cavities being aligned parallel to each other. The cavities are tuned by tuning plungers which are simultaneously moved to predetermined positions within the cavity. Waveguide filters of this type are cumbersome to operate.

SUMMARY OF THE INVENTION

The present invention utilizes one or more cylindrical resonant cavities which are coaxially aligned along their vertical axis and are coupled to the broadwall of a main waveguide by asymmetrically aligned with the centerline thereof.

It is one object of the present invention, therefore, to provide an improved dual mode directionally coupled band reject filter apparatus.

It is another object of the invention to provide an improved dual mode directionally coupled band reject filter apparatus utilizing one or more cylindrical resonant cavities aligned along their central axis.

It is another object of the invention to provide an improved dual mode directionally coupled band reject filter apparatus wherein said cylindrical cavities are asymmetrically coupled to the broadwall of a main waveguide.

It is still another object of the invention to provide an improved dual mode directionally coupled band reject filter apparatus wherein one or more tuning screws are utilized in each cylindrical cavity.

These and other advantages, objects and features of the invention will become more apparent after considering the following description taken in conjunction with the illustrative embodiment in the accompanying drawings.

BRIEF DESCRIPTION OF THE DRAWINGS

FIG. 3 is a cross-sectional view of the filter apparatus which is shown in FIG. 1 taken along the section line 3—3, FIG. 4 is a cross-sectional view of FIG. 1 taken along the section line 4—4, and, FIG. 5 is a cross-sectional view of FIG. 1 taken along the section line 5—5.

DESCRIPTION OF THE PREFERRED EMBODIMENT

Figure 1:
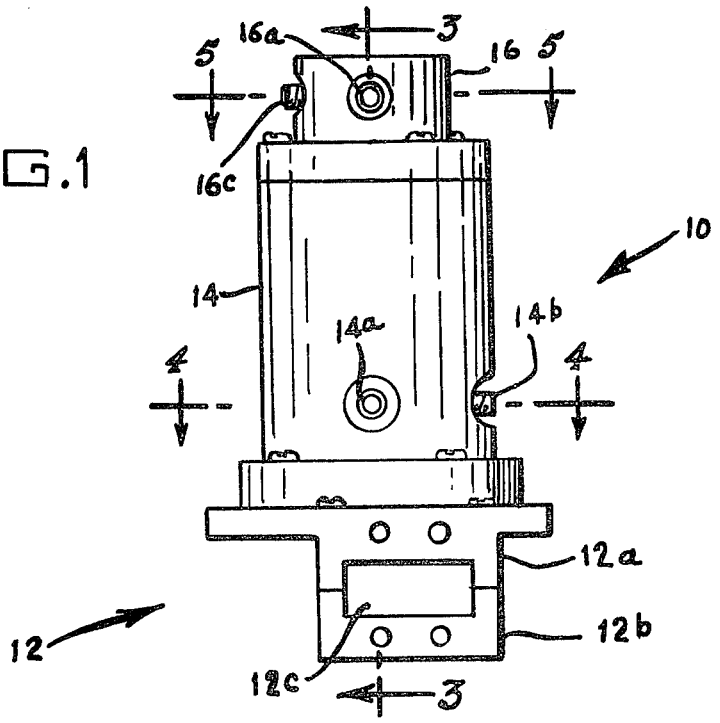
FIG. 1 is a front view of the dual mode directionally coupled band reject filter apparatus according to the present invention.

Referring now to FIG. 1, there is shown a dual mode directionally coupled band reject filter apparatus 10. A waveguide housing 12 is comprised of an upper and lower housing member 12*a*, 12*b*, and has defined therein a standard waveguide 12*c*. It may be noted that the waveguide, 12*c* is offset to one side of the vertical centerline for the dual mode directionally coupled band reject filter apparatus 10.

A first cylindrical cavity member 14 is shown mounted to the top of upper housing member 12*a*. The first cylindrical cavity member 14 is positioned in the vertical plane above the waveguide housing 12. A first tuning screw 14*a* is shown positioned in the front face of the first cylindrical cavity member 14 and is centered on the central vertical axis thereof. The first cylindrical cavity member 14 includes two additional tuning screws 14*b*, 14*c* of which only the second tuning screw 14*b* is partially visible. The third tuning screw 14*c* which is not shown in this view but which is in the same plane as the first and second tuning screws 14*a*, 14*b*, is shown in the cross-sectional view of FIG. 4.

There is shown a second cylindrical cavity member 16 which is mounted to the top of the first cylindrical cavity member 14. The second cylindrical cavity member 16 is symmetrically positioned on the central vertical axis of the first cylindrical cavity member 14. A fourth tuning screw 16*a* is shown positioned in the front face of the second cylindrical cavity member 16 and is centered on the central axis thereof in alignment with the first tuning screw 14*a*. The second cylindrical cavity member 16 includes two additional tuning screws of which only the sixth tuning screw 16*c* is partially visible. Both tuning screws are in the same plane as the fourth tuning screw 16*a* and which will be shown and discussed in FIG. 5.

Figure 2:
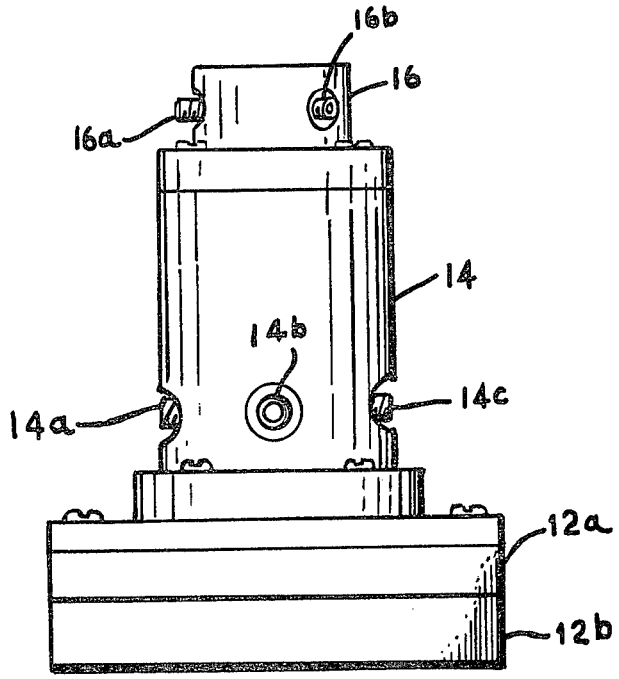
FIG. 2 is a right side view of the filter apparatus that is shown in FIG. 1.

Turning now to FIG. 2, there is shown a right side view of the dual mode directionally coupled band reject filter apparatus. It may be noted that while the first and second cylindrical cavity members 14, 16 are exactly centered about the midpoint of the longitudinal length of the waveguide housing 16, the operation of the present invention does not require this particular alignment. The waveguide housing 12 is formed into the upper and lower housing members 12*a*, 12*b* which contain therein a standard dimensioned waveguide. The first cylindrical cavity member 14 which is mounted to and communicates with the waveguide in the waveguide housing 12, contains a second tuning screw 14*b*. The second tuning screw 14*b* is in the same plane as the first and third tuning screws 14*a*, 14*c* both of which are partially shown. The second tuning screw 14*b* is rotated 90° in the counter clockwise direction with respect to the first tuning screw 14*a*. There is shown on the second cylindrical cavity member 16 the fifth tuning screw 16*b*. The fifth tuning screw 16*b* is in the same plane as the fourth tuning screw 16*a* which is shown in FIG. 1 but is rotated 135° in the counter clockwise direction with respect to the fourth tuning screw 16*a*.

In FIG. 3 there is shown a cross-sectional view of the dual mode directionally coupled band reject filter apparatus of FIG. 2, taken along the section line 3—3. The upper and lower housing members 12*a*, 12*b* has equally disposed therein a standard rectangular waveguide 18. The first cylindrical cavity 14 communicates with the waveguide 18 by means of a first circular hole 20. There is shown in the second cylindrical cavity member 16 sidewall, the sixth tuning screw 16*c*. The second cylindrical cavity member 16 which is mounted on top of the first cylindrical cavity member 14 communicates with the first cylindrical cavity member 14 by means of a second circular hole 22.

There is shown in FIG. 4 a cross-sectional view of the first cylindrical cavity member 14 taken along the section line 4—4 of FIG. 1. The orientation of the first, second and third tuning screws 14*a*, 14*b* and 14*c* is clearly illustrated. The second tuning screw 14*b* is positioned 90° in the counter clockwise direction with respect to the first tuning screw 14*a*. The third tuning screw 14*c* is positioned in the 90° counter clockwise direction with respect to the second tuning screw 14*b* and is positioned 180° in the counter clockwise direction with respect to the first tuning screw 14*a*. There is shown in the center of the first cylindrical cavity member 14, the first circular hole 20.

In FIG. 5 there is shown a cross-sectional view of the second cylindrical cavity member 16 taken along the section line 5—5 of FIG. 1. The orientation of the fourth, fifth and sixth tuning screws 16*a*, 16*b*, 16*c* is clearly illustrated. The fifth tuning screw 16*b* is positioned 135° counter clockwise with respect to the fourth tuning screw 16*a*. It may be noted that the fifth tuning screw 16*b* may also be referred to as a coupling screw even though all screws can have the same physical construction. The sixth tuning screw 16*c* which is positioned 135° counter clockwise with respect to the fifth tuning screw 16*b*, is positioned 90° in the clockwise direction with respect to the fourth tuning screw 16*a*. There is shown centrally located within the second cylindrical cavity member 16, the second circular hole 22 which communicates with the first cylindrical cavity member 14.

While the present invention has been described with respect to the use of a two cavity stack, it should be well understood that the dual mode, directionally coupled band reject filter apparatus may be comprised of either a single cavity or a stack of cavities which are coupled to the broad wall of the main waveguide. In either case, however, the cavity or cavities are offset from the centerline of the main waveguide in such a manner such that both modes (i.e., "odd" and "even") are excited. This is a form of dual mode operation since it provides two response poles for each cavity. The stacked arrangement also allows for elliptic-type responses by the proper placement of 45° coupling screws in intermediate cavities.

Although the invention has been described with reference to a particular embodiment, it will be understood to those skilled in the art that the invention is capable of a variety of alternative embodiments within the spirit and scope of the appended claims.

What is claimed is:

1. A dual mode directionally coupled band reject filter apparatus comprising in combination:

a waveguide housing containing a waveguide therein, a first cylindrical cavity member mounted to the top of said waveguide housing, said first cylindrical cavity member containing a cavity means therein, said cavity means communicating with said waveguide through the broadwall of said waveguide housing, said cavity means being offset with respect to the centerline of said broadwall of said waveguide, and, a second cylindrical cavity member mounted to the top of said first cylindrical cavity member, said second cylindrical cavity member coaxially aligned with said first cylindrical cavity member, said second cylindrical cavity member forming a second cavity therein, said second cavity communicating with said cavity means in said first cylindrical cavity means.

2. A dual mode directionally coupled band reject filter apparatus as described in claim 1 wherein said waveguide housing comprises an upper housing member and a lower housing member, said waveguide being symmetrically disposed within said upper and lower housing member in the vertical direction and said waveguide being a symmetrically offset within said upper and lower housing member in the horizontal direction.

3. A dual mode directionally coupled band reject filter apparatus as described in claim 1 wherein said first and second cylindrical cavity member respectively include tuning means mounted therein.

4. A dual mode directionally coupled band reject filter apparatus as described in claim 1 wherein said cavity means has a diameter that is greater than the diameter of said second cavity.

5. A dual mode directionally coupled band reject filter apparatus as described in claim 1 wherein said cavity means communicates with said waveguide by means of a first circular hole.

6. A dual mode directionally coupled band reject filter apparatus as described in claim 1 wherein said second cavity communicates with said cavity means by means a second circular hole.

7. A dual mode directionally coupled band reject filter apparatus as described in claim 2 wherein said upper housing member has disposed in its upper portion a first cavity section which communicates with said cavity means, said upper housing member having a small circular hole centered in said first cavity section and extended therefrom to said waveguide.

8. A dual mode directionally coupled band reject filter apparatus as described in claim 3 wherein said tuning means comprises a plurality of tuning screws.

9. A dual mode directionally coupled band reject filter apparatus as described in claim 8 within said plurality of tuning screws comprise three tuning screws mounted in the same plane in said first cylindrical cavity member and three tuning screws mounted in the same plane in said second cylindrical cavity member.

* * * * *